United States Patent [19]

Furuno et al.

[11] Patent Number: 4,501,649

[45] Date of Patent: Feb. 26, 1985

[54] METHOD OF CONTROLLING ELECTROCOATING BATH AND APPARATUS THEREFOR

[75] Inventors: Nobuo Furuno, Amagasaki; Yoshio Ota, Tsuzuki; Masahiro Itai, Osaka; Akio Tokuyama; Eiichi Nakano, both of Hirakata, all of Japan

[73] Assignee: Nippon Paint Co., Ltd., Osaka, Japan

[21] Appl. No.: 548,139

[22] Filed: Nov. 2, 1983

[30] Foreign Application Priority Data

Nov. 6, 1982 [JP] Japan ..... 57-195151

[51] Int. Cl.[3] ..... C25D 13/24

[52] U.S. Cl. ..... 204/181 R; 204/299 EC

[58] Field of Search ..... 204/181 R, 300 EC, 299 EC, 204/149, 152

[56] References Cited

U.S. PATENT DOCUMENTS

| | | | |
|---|---|---|---|
| 2,800,447 | 7/1957 | Graham, Jr. | 204/299 EC |
| 3,663,403 | 5/1972 | Christenson et al. | 204/181 R |
| 3,682,806 | 8/1972 | Kinsella et al. | 204/181 R |
| 4,032,420 | 6/1977 | Boldebuck et al. | 204/181 R |

*Primary Examiner*—John F. Niebling
*Assistant Examiner*—B. J. Boggs, Jr.
*Attorney, Agent, or Firm*—Wenderoth, Lind & Ponack

[57] ABSTRACT

The present invention provides a method of controlling an electrocoating bath using an ion exchange resin. The ion exchange resin is maintained in a porous container in a suspended state in the electrocoating bath, and is used in a quantity of not more than the chemical equivalent of excess counter-ion to be removed from the bath. Bath control is easily achieved without any coagulation trouble as often observed in conventional column methods.

9 Claims, 7 Drawing Figures

METHOD OF CONTROLLING ELECTROCOATING BATH AND APPARATUS THEREFOR

BACKGROUND OF THE INVENTION

Hitherto, control of an electrocoating bath by an ion exchange resin has been carried out by a column method, in which the ion exchange resin is densely filled into the column, so excess counter-ions in the bath are removed, and electrocoating resinous vehicle solubilized by the counter-ion is coagulated in the column. Though many improvements have been proposed for the control of such an elimination of the excess counter-ion in the column method (i.e. Japanese Patent Publication Nos. 23655/1973 and 40457/1973), they are far from a satisfactory solution of the above problems.

SUMMARY OF THE INVENTION

The present invention relates to a method of controlling an electrocoating bath, especially the concentration of counter-ion in the bath. An ion exchange resin is used at not more than the chemical equivalent of excess counter-ion, in a freely suspended state in the electrocoating bath, different from conventional column methods, so that the coagulation of the ion exchange resin in the electrocoating bath is prevented, and the control is effected easily.

BRIEF DESCRIPTION OF DRAWINGS

FIGS. 4 and 5 are schematic views of a testing device used in Example 1, wherein FIG. 5 is the I—I section view of FIG. 4.

DETAILED DESCRIPTION OF INVENTION

Figure 1:
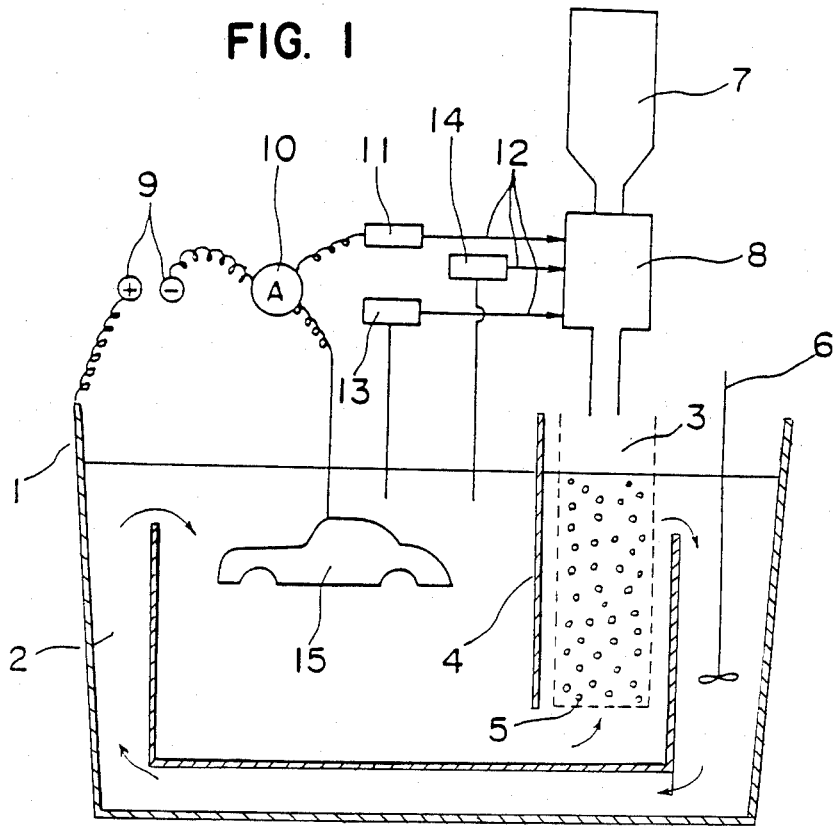
FIGS. 1, 2 and 3 are schematic views of embodiments of the present invention.

The present invention relates to a method of controlling the composition of an electrocoating bath, especially to a method of controlling the counter-ion concentration in the electrocoating bath by treating the electrocoating bath in an electrocoating tank.

A major problem in a continuous electrocoating process has been the control of the electrocoating bath to maintain the initial paint properties. The solubilized electrocoating vehicle resin may be characterized as a polyelectrolyte, that is, a polyacid or a polybase solubilized by a water-soluble base in the first instance, and by a water-soluble acid in the second instance. When the vehicle resin is coated upon an article serving as an anode in the case of the polyacid, and a cathode in the case of a polybase, the counter-ion remain in solution, which is the base or acid used to solubilize the resin. The control or removal of excess counter-ion has been attacked by many means. Among these, circulating the bath through an ion-exchange resin is a popular and conventional means.

The conventional means using an ion exchange resin are carried out by passing an electrocoating bath through an ion exchange resin column (referred to as the column method hereinafter) equipped separately from an electrocoating tank, which has an inherent defect. In the column method, excess ion exchange resin usually must be filled in the column, so that the counter-ion may be removed excessively from the electrocoating bath and the vehicle resin may be coagulated, which may cause clogging in the column, contamination and damage of the resin, and lowering of operating efficiency. In order to prevent such problems, several means such as the control of passage rate of the electrocoating bath have been applied, but the control is very difficult.

Further, the column method theoretically achieves the perfect ion exchange, and so is an especially suitable method for such a purpose, but for the electrocoating bath the perfect removal of the counter-ion should not be achieved because of the coagulation of the vehicle resin. Therefore, the column method is not suitable for the treatment of the electrocoating bath.

We have now found that the above problems in the control of the electrocoating bath using an ion exchange resin can be solved by using the ion exchange resin at an ion exchange capacity not more than the chemical equivalent of the counter-ion to be removed.

Further, we have now found that in order to solve the above problems, it is important that the same electrocoating resin vehicle does not contact the ion exchange resin for a long time. That is, the problems have been solved by circulating the electrocoating bath through a container maintaining the ion exchange resin under the condition that the ion exchange resin particles are suspended without closely contacting each other.

According to the present invention, there is provided a method of controlling an electrocoating bath which comprises removing excess counter-ion in the electrocoating bath by an ion exchange resin, wherein the ion exchange resin is suspended in the electrocoating bath contained in a porous container equipped in an electrocoating system at an ion exchange capacity not more than the chemical equivalent of the excess counter-ion to be removed. Also provided is an apparatus therefor.

The term "suspension of ion exchange resin" means the state that the ion exchange resin particles freely disperse or float without accumulation or close contact among the particles. In order to maintain a suitable suspension of ion exchange resin, the volume percentage of the ion exchange resin to the electrocoating bath in the container is adjusted between 67 to 0.1 percent, preferably 30 to 2 percent, and the electrocoating bath may be passed through the container upwardly at a flow rate of at least 0.1 cm/sec., preferably from 1 cm/sec. to 30 cm/sec.

Figure 2:
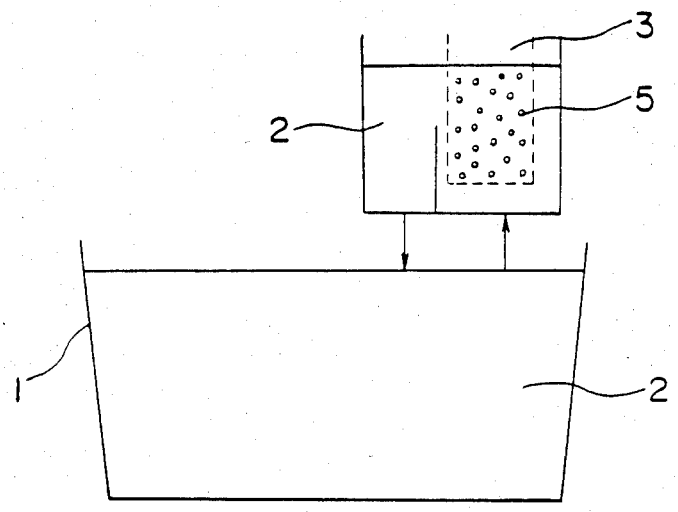
Figure 3:
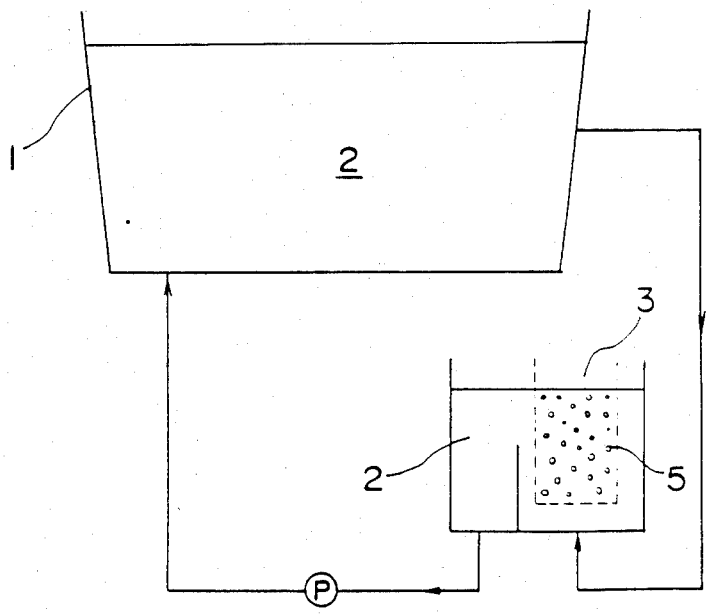

The electrocoating system according to the present invention includes a system wherein the container containing the ion exchange resin is directly dipped into the electrocoating bath as shown in FIG. 1, and systems wherein the container containing the ion exchange resin is dipped into another tank connected with the electrocoating tank as shown in FIGS. 2 and 3.

An embodiment of the present invention is illustrated according to FIG. 1.

In the drawings, each number represents:

(1) electrocoating tank,
(2) electrocoating bath,
(3) container,
(4) screen,
(5) ion exchange resin,
(6) stirrer,
(7) ion exchange resin supply tank,
(8) addition controller,
(9) current source,

(10) ammeter,
(11) integrator,
(12) input signal,
(13) pH meter,
(14) conductance meter,
(15) article to be coated, and
(16) counter electrode.

In FIG. 1, a container (3) holding an ion exchange resin (5) is directly dipped into an electrocoating bath (2) in an electrocoating tank (1). The concentration of counter-ion in the electrocoating bath becomes excessive with the progress of electrocoating. The electrocoating bath is passed through the container (3) under circulating flow caused by a stirrer (6), so that the counter-ion is absorbed by the ion exchange resin to be removed from the electrocoating bath.

The container of the present invention is made from porous material such that it can retain the ion exchange resin and pass the electrocoating bath, for example, wire net, synthetic fiber net, a basket and the like, and preferably is porous at the bottom and the side. In FIG. 1, a basket type container is used but the invention is not restricted thereto, and of course a net screen is applicable.

Upward flow for suspending the ion exchange resin in FIG. 1 is caused by stirring the electrocoating bath in the electrocoating tank equipped with a stirrer and a suitably formed screen or barrier constituting a circuit. In this case, once a circulating flow is established, the upward flow sufficient to suspend the ion exchange resin can be maintained by extremely slight stirring. The circulating flow may be made by a pump or a stirrer equipped in the container. In the latter case, as the ion exchange resin may be damaged sometimes, a moderate stirring should be applied.

The suspension of the resin can be effected by maintaining the flow conditions of the bath at the critical Reynold's number or more (turbulent flow).

In the embodiment of FIG. 1, the electrocoating bath in the container and the bath in the electrocoating tank can be kept at substantially the same level, so that a uniform circulating flow is formed without any local accumulation of ion exchange resin. The ion exchange resin (5) in the container (3) is carried upward with the circulating flow and is settled by its own weight to suspend freely and not to deposit closely at the bottom, different from the column method, so that neither local excess elimination of the counter-ion nor coagulation of the electrocoating vehicle resin arises, and even and effective elimination of the excess counter-ion can be achieved. In addition, as the pressure on the electrocoating bath in the container is substantially equal to the pressure on the electrocoating bath outside the container, the circulation of the bath can smoothly be achieved without adhesion of the ion exchange resin which may coagulate the electrocoating vehicle resin as in the column method.

The ion exchange resin may be added gradually from a supply tank in a necessary amount with the progress of electrocoating. The amount should be controlled up to the chemical equivalent of the excess counter-ion to be removed. Using the ion exchange resin more than the chemical equivalent, the electrocoating is affected adversely, and in some cases, a coagulated vehicle resin will appear.

The ion exchange resin may be added automatically by an addition controller (8) in response to an input signal (12) from an integrator (11). In case that the amount of the addition estimated by the input signal from the integrator is abnormal, an accidental excess addition of ion exchange resin may be prevented by the actuation of an input signal from a pH meter (13) and a conductance meter (14). A reacted ion exchange resin may be removed intermittently using a proper filter device from the electrocoating system, when a suitable amount of the ion exchange resin is charged.

When the amount of ion exchange resin increases in the container to the extent that it is not sufficiently suspended, the container is pulled up, and the resin may be regenerated outside the electrocoating system.

The following are differences between the method of the present invention and the conventional column method.

Ion exchange reaction is a liquid/solid interphase reaction, so that it does not immediately progress as a uniform reaction and needs a fairly long time to react. Accordingly, in the column method, too fast passage of flow results in an insufficient reaction. Therefore, the productivity is low. Further, a lengthy contact of electrocoating bath with the ion exchange resin causes local coagulation, for which the flow rate of the bath must be kept comparatively fast using stoichiometrically excess ion exchange resin. According to the present invention, even if the circulation of the electrocoating bath is continued endlessly, the extent of ion exchange will not be more than the ion exchange capacity of the ion exchange resin. Therefore, so far as the resin is used in an amount not more than the chemical equivalent of the counter-ion to be removed, coagulation does not arise, and longer contact of electrocoating bath and ion exchange resin can be maintained, and more perfect ion exchange effect within the excess counter-ion can be achieved, which is more preferable for the purpose of control of the electrocoating bath.

The present invention may be operated according to embodiments as shown by FIGS. 2 and 3, wherein the electrocoating bath may be treated with the ion exchange resin contained in the container dipped into a tank placed outside and connected with the electrocoating tank. Usually, as the electrocoating bath is used under atmospheric pressure, the concentration of the counter-ion in the electrocoating bath may preferably be controlled using the ion exchange resin maintained in the container under atmospheric pressure. Maintenance of the suspension state of the ion exchange resin in the container without close contact may be achieved by controlling the charge and drainage of the electrocoating bath in the station carrying out the ion exchange.

As aforementioned, the present invention is completely different from the conventional column method, and may be summarized by conducting the ion exchange reaction at an ion exchange capacity not more than the chemical equivalent of the excess counter-ion to be removed from the electrocoating bath.

The ion exchange capacity of the ion exchange resin to be used may be determined by the kind and quantity of vehicle resin consumed by the electrocoating. As the capacity usually relates to the coating area or electrical quantity, these may be used as input to determine automatically the amount of the ion exchange resin to be used, so that the electrocoating bath may be controlled automatically. Therefore, in accordance with the present invention, the excess counter-ion in the electrocoating bath and also the variation of the pH value of the electrocoating bath can basically be prevented. Therefore, the continuous maintenance or control of the electrocoating bath can be achieved with remarkably economic application.

The following examples set forth specific embodiments of the present invention. However, the invention is not to be construed as being limited to these embodiments for there are, of course, numerous possible variations and modifications.

EXAMPLE 1

Figure 4:
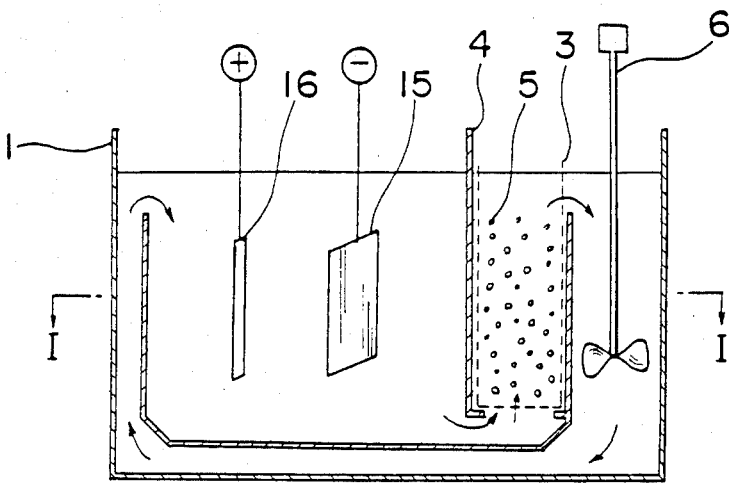
Figure 5:
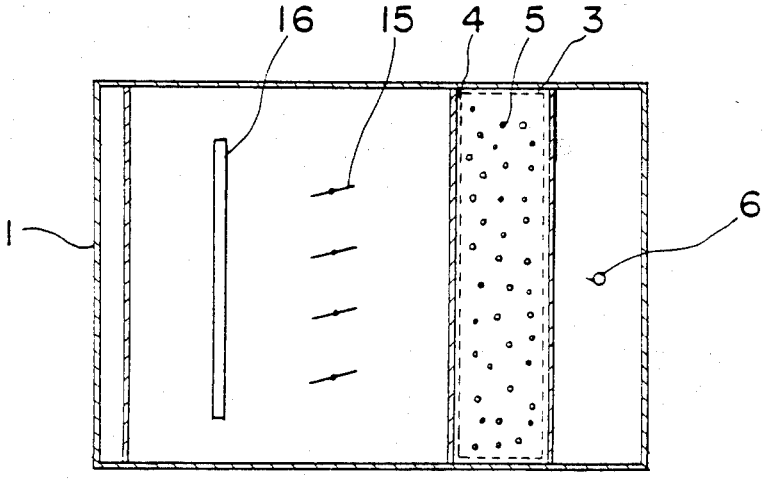

A stainless steel electrocoating tank of 20 liters (1) (38 cm×26 cm×23 cm, effective content: 22 cm×24 cm×18 cm) as illustrated by FIGS. 4 and 5 (I—I cross section view of FIG. 4) equipped with a stirrer (6), a screen (4), a container (6 cm×24 cm×16 cm, pore size: 100 mesh in three faces having a total area of 500 $cm^2$ (70% of total face area) with handle) (3) and a counter electrode (16) is used.

In the above electrocoating tank, cationic electrocoating paint (PTU-30 dark gray, acetic acid 24 meq/100 g (solid), solid content: 20%, available from Nippon Paint Co., Ltd.) is charged.

Four cold-rolled steel plate test pieces (0.8 mm×70 mm×150 mm) (15) are dipped into the electrocoating bath, which are electrocoated while circulating the bath at a rate of 10 to 20 liters per minute by the stirrer (6), at 50 coulomb per four test pieces, at 28° C. and at 150 V. The test pieces are replaced with new ones every three minutes. By this method, a solid coating of 0.5 g is formed on each test piece (corresponding to 24 $g/m^2$).

Figure 6:
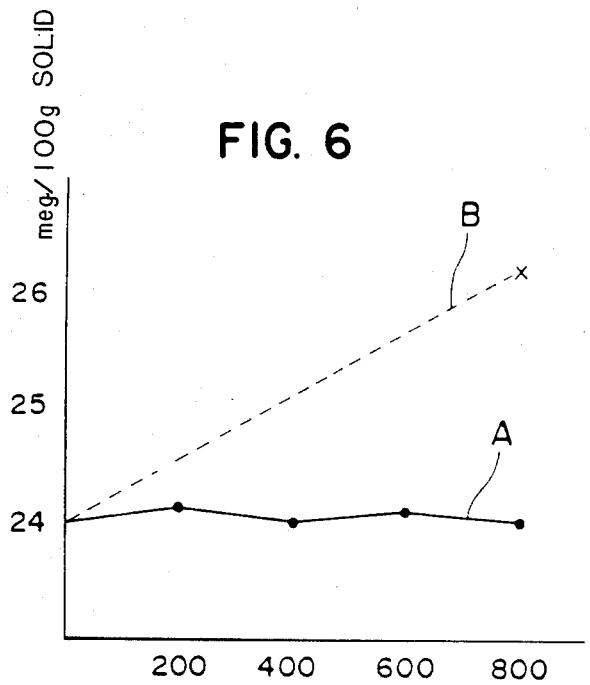
FIG. 6 is a graph showing the change of concentration of the counter-ion obtained in Example 1.

Anion exchange resin (Amberlite IRA-400, particle size: 0.4–0.53 mm, ion exchange capacity: 0.77 meq/1 ml of resin, available from Organo K.K.) is added to the container at a proportion of 5.7 ml per 40 test pieces. Under the instant condition, 800 test pieces are electrocoated. The solid content of the bath is adjusted to 20 percent using the supply paint (solid: 40%) every time when 400 test pieces are electrocoated. The concentration of the counter-ion (meq/100 g solid) is determined every time when 200 test pieces are electrocoated. The results are shown in FIG. 6, wherein the ordinate indicates the concentration of the counter-ion (meq/100 g solid) and the abscissa indicates the number of the coated test pieces, and (A) and (B) represent the concentrations of counter-ion in the case of the present invention, and in the case of no ion exchange resin being used, respectively.

As apparent from the above results, according to the present invention, the concentration of the counter-ion in the electrocoating bath can be controlled within a suitable range. In addition, even after the treatment of 800 test pieces, no coagulation of the ion exchange resin or settlement are observed, whereas non-use of ion exchange resin leads to a thinner coated film and deterioration of the appearance of the coated article with the progress of the electrocoating.

EXAMPLE 2

Figure 7:
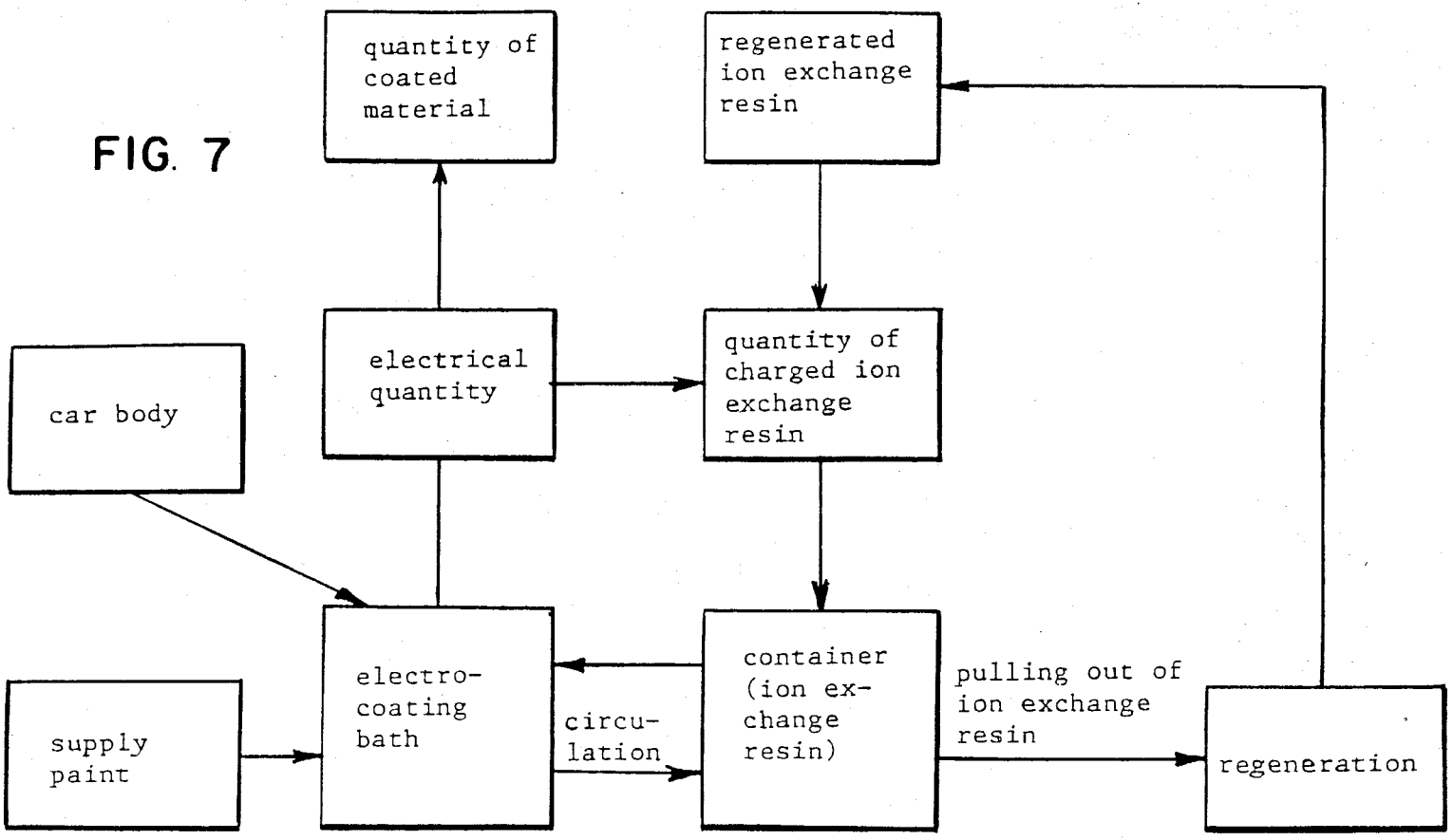
FIG. 7 illustrates a flow sheet of the electrocoating process in Example 2.

The method according to the present invention is applied to an electrocoating line for cars. The conditions of electrocoating and ion exchange are shown in Table 1 and the flow sheet for practising this Example is shown in FIG. 7.

TABLE 1

| Conditions | |
|---|---|
| Number of coated cars: | 130/7 hours |
| amount of electrocoating bath: | 100 ton |
| coated area: | 50 $m^2$/one car |

TABLE 1-continued

| Conditions | |
|---|---|
| coated quantity per car: | 1 kg/one car |
| electrocoating resin: | PTU-30[1] (solid 20%) |
| coulomb efficiency: | 40 mg/C |
| equivalent of remaining counter-ion[2]: | acetic acid, 25 meq/100 g (solid) |
| ion exchange resin: | Amberlite IRA-400[3] |
| ion exchange capacity: | 1 meq/1 ml swelled resin (regenerated) |
| container capacity: | 1.7 $m^3$ |
| circulation rate: | 800–1500 1/min.[4] |

NOTE:
[1]PTU-30: cationic electrocoating paint available from Nippon Paint Co., Ltd.
[2]Quantity of counter-ion remaining in the electrocoating bath during electrocoating (quantity in electrocoating bath: 28 meq/100 g (solid) and quantity in coated film: 3 meq/100 g (solid).
[3]Amberlite IRA-400: anionic ion exchange resin available from Organo K.K.,
[4]In this range, the whole quantity of the electrocoating bath can pass through the container within one to two hours.

The electrocoating is carried out according to the conditions as shown in Table 1 and flow sheet illustrated in FIG. 7. Ten ml of ion exchange resin is supplied to the container every 1000 coulomb. In case 130 cars are coated within 7 hours, about 32.5 liters of the ion exchange resin are used at the time the ion exchange resin is removed from the bath. The concentration of the counter-ion is 28 meq/100 g (solid) initial, and this value was maintained after 7 hours operation. Every seven hours, supply paint 130 kg (solid) is added, and the concentration of the counter-ion is controlled by the above method three times a day for 25 days of operation a month. The current quantity is kept at 28 meq/100 g (solid) after one month operation, and appearance and finish of the coated articles are excellent.

What is claimed is:

1. A method of controlling the composition of an electrocoating bath which comprises removing excess counter-ion in the electrocoating bath by means of an ion exchange resin, wherein the ion exchange resin, contained in a porous container equipped in an electrocoating system, is suspended in the electrocoating bath at an ion exchange capacity of not more than the chemical equivalent of the excess counter-ion to be removed, said porous container permitting passage of the electrocoating bath therethrough to provide direct contact between the electrocoating bath and the ion exchange resin.

2. The method of claim 1, in which the ion exchange resin is added to the electrocoating bath in proportion to the chemical equivalent of the counter-ion which is formed in excess with progress of electrocoating.

3. The method of claim 1, in which the chemical equivalent of the counter-ion to be removed is determined based on coated area or current quantity used in the electrocoating.

4. The method of claim 1, in which the suspension of the ion exchange resin is effected by maintaining an upward flow rate of the electrocoating bath at a final settling rate of the ion exchange resin or more.

5. The method of claim 1, in which the suspension is effected by maintaining the flow conditions of the electrocoating bath at the critical Reynolds' number or more.

6. The method of claim 1, in which a given quantity of the ion exchange resin is maintained in the porous container which passes the electrocoating bath but does not pass the ion exchange resin, and the electrocoating bath is circulated through the container under atmospheric pressure.

7. The method of claim 6, in which the ion exchange resin is suitably removed from the electrocoating bath.

8. An apparatus for controlling the composition of an electrocoating bath by removing a counter-ion from the bath, which comprises a container for an ion exchange resin, which passes the bath but does not pass the ion exchange resin, provided in an electrocoating tank or another tank linked with the electrocoating tank; means for circulating the electrocoating bath and forming an upward flow having an upward flow rate proportional to at least a final settling rate of the ion exchange resin through the container; and an ion exchange resin supply tank for supplying an ion exchange resin into the container at an ion exchange capacity of not more than the chemical equivalent of the counter-ion to be removed.

9. The apparatus of claim 8, in which the container is provided in the electrocoating tank.

* * * * *